US005660542A

United States Patent [19]

Rinker et al.

[11] Patent Number: 5,660,542

[45] Date of Patent: Aug. 26, 1997

[54] CUPOLA BURNER

[75] Inventors: Franklin G. Rinker, Perrysburg; William C. Rinker, Toledo, both of Ohio

[73] Assignee: Maumee Research & Engineering Incorporated, Perrysburg, Ohio

[21] Appl. No.: 141,407

[22] Filed: Oct. 22, 1993

[51] Int. Cl.[6] ..... F27D 7/00

[52] U.S. Cl. ..... 432/19; 432/24; 432/99; 432/36; 432/37; 432/248; 431/89; 431/90; 431/12

[58] Field of Search ..... 432/19, 24, 99, 432/36, 37, 248; 431/89, 90, 12

[56] References Cited

U.S. PATENT DOCUMENTS

| | | | |
|---|---|---|---|
| 4,421,473 | 12/1983 | Londerville | 431/89 |
| 4,509,912 | 4/1985 | VanBerkum | 431/12 |
| 4,568,266 | 2/1986 | Bonne | 431/12 |
| 4,798,531 | 1/1989 | Breckner | 431/90 |
| 4,887,958 | 12/1989 | Hagar | 431/89 |
| 4,927,351 | 5/1990 | Hagar et al. | 431/90 |
| 5,190,454 | 3/1993 | Murray et al. | 431/89 |

FOREIGN PATENT DOCUMENTS

| | | | |
|---|---|---|---|
| 56-10622 | 2/1981 | Japan | 431/89 |

OTHER PUBLICATIONS

Stordy Combustion Engineering Ltd., Subject: Supplementary Gas Firing of Cold Blast Cupolas, pp. 1 & 2, by M. R. Bennett.

S. Page, E. Eng., A.M. Inst. F., Supplementary Natural–Gas Firing of Cold Blast Cupolas, Reprinted from Foundry Trade Journal Apr. 13, 1972, published Heath Mill Road, Wombourne, Staffs., England.

Giessereiforschung in English, 1970, v.22, No. 1, A. Dahlmann, D. Schock & K. Orths, Issue under license of No. 1, 1970 of the Journal Giessereiforschung, published by the Verein Deutscher Giessereiforschung e.V.

*Primary Examiner*—Henry A. Bennett
*Assistant Examiner*—Siddharth Ohri
*Attorney, Agent, or Firm*—Brinks Hofer Gilson & Lione

[57] ABSTRACT

A method and apparatus for controlling the operation of a plurality of burners of a cupola. The method includes the steps of separately supplying air and fuel to each burner of the cupola, measuring the flow rates of air and fuel supplied to each burner, controlling either the flow rate of air or flow rate of fuel supplied to each burner as a function of a desired heat energy output of the burners and controlling the other of the flow rate supplied to each burner as a function of the measured flow rate of air or fuel supplied to each burner and a preselected ratio of flow rate of air supplied to each burner and of flow rate of fuel supplied to each burner.

27 Claims, 7 Drawing Sheets

CUPOLA BURNER

FIELD OF THE INVENTION

This invention relates to supplemental fuel firing for a cupola and the control system therefore. More particularly, this invention relates to an improved cupola utilizing supplemental fuel firing burners and the control system for operating each of the fuel firing burners to provide individual burner air and fuel flow control.

BACKGROUND OF THE INVENTION

A cupola is either a refractory lined or a water cooled vertical shaft open at the top and bottom used for melting scrap metal such as iron and steel for subsequent use in castings. An outer metal plate shell provides protection and support for the materials charged to the cupola that are processed in the cupola. In operation, coke is charged to the cupola and extends upward a predetermined height from the bottom of the cupola to form a coke bed. Next, the coke bed is ignited and alternate charges of flux material, scrap metal and coke are charged to the cupola to a predetermined height. Forced air is then added to the burning coke bed through tuyeres or openings which extend through the metal plate shell and refractory or water cooled wall to the combustion zone just above the coke bed such that combustion occurs rapidly within the coke bed. The air, which may be preheated, is supplied from a suitable blower through a blast pipe to an equalizing chamber called a windbox. The windbox completely encircles the cupola to supply air uniformly to the tuyeres. The coke is burned with the forced air to produce high temperature products of combustion. The high temperature products of combustion inherently ascend through the scrap metal, exchange heat with the scrap metal and melt the scrap metal and then exit out the top of the cupola at a relatively lower temperature.

As the coke burns a sizable and constant thermal gradient is created between the portion of the metal scrap nearest the burning coke bed and the scrap metal nearest the top of the stack. The hottest scrap metal on the burning coke bed melts becoming more fluid and descends through the burning coke thereby dissolving the carbon from the coke. In this manner, as the scrap metal melts and descends to the bottom of the cupola the balance of the scrap metal on top of the coke bed also descends downward in the vertical shaft of its own weight such that a new portion of solid scrap metal automatically settles into the melting zone and room is continually made available for the addition of new scrap metal at the top of the cupola. The melted scrap metal which descends to the bottom of the cupola may be collected in a well at the base of the coke bed and periodically tapped as needed. The composition of the melted scrap metal collected in the well is determined by the composition of the charges and by the various reactions that take place during and after melting.

As previously described, limestone and other suitable fluxes are continually charged to the cupola along with the scrap metal to remove the ash containing oxides and other unwanted materials remaining from the combustion process and prevent the ash from accumulating and blocking the shaft and rendering the cupola inoperative. The ash is calcined upon arrival at the coke bed such that the ash may be removed from the cupola as slag. The calcium oxide reacts with the ash to produce heat and fluid calcium silicate which drips down through the bed of burning coke. Being lighter than the molten metal, it floats to the top of the well and is then removed.

Traditionally, cupolas have used coke as both a fuel and as a support for the charge of iron and limestone. Notwithstanding, the use of coke as a fuel is less than satisfactory because coke is continually increasing in cost due to the relative scarcity of good coking coals. In addition, coke naturally adds impurities such as sulfur to the product metal, and causes emissions of sulfur oxides and fine particles. Accordingly, there have been a number of attempts to eliminate coke for iron melting.

One attempt to eliminate coke for iron melting involves the use of gas as the only fuel. The use of gas is desirable because it is virtually sulfur free and also eliminates the majority of undesirable emissions, especially dust. However, there are a number of problems which affect product quality associated with the use of a gaseous fuel. For example, the use of gas as the only fuel results in a loss of carbon from the metal. Furthermore, in a gas fueled cupola it is difficult to achieve adequate metal temperature because heat transfer from a hot gas produced by a gas fuel is less effective than direct contact heating with coke in a coke fueled cupola.

In an attempt to overcome the deficiencies of a coke fueled or gaseous fueled cupola, it has been found that gaseous fuel may be used to replace at least 25 percent of the energy typically supplied in a coke fueled cupola with minimal effect on metal quality and overall thermal performance of the cupola. Accordingly, by replacing part of the coke fuel with gas, the total impurity and emission levels may be reduced, quality of the product metal improved and manufacturing costs decreased, e.g., gas is currently available at about 60% of the cost of coke. Supplemental gas fuel firing of the cupola also results in increased productivity and throughput of the cupola. A gas supplemented cupola allows the upper preheating zone of the cupola to be optimized independently at a higher blast rate when compared with the lower reduction and melting zones of the cupola. For example, typical foundries that use a significant amount of steel in the making of iron operate with a blast rate of 325 $cfm/ft^2$ in the lower zones. The use of gas supplemented cupolas allows the blast rate to be increased to more than 325 $cfm/ft^2$ in the preheating zone.

Although, it has been found that improved efficiency and productivity may result from the use of a supplemental fuel such as gas in a coke fueled cupola, precision control of gas combustion is required for efficient cupola operation. The water formed by gas combustion has been found to react endothermically with the coke in the cupola thereby reducing the reaction temperature in the cupola. Furthermore, the available oxygen in the cupola for combustion has been found to react with the coke in preference to the gas thereby rendering the addition of gas largely ineffective.

In addition, standard burner control technology typically controls the air/fuel ratio ("A/F ratio") to the burner by a pressure signal from the air flow conduit to a fuel flow regulator. The pressure balance system operates by setting an air flow valve within the air flow conduit in a predetermined set position required for operation. Downstream of the air flow valve is a pressure line in communication with a fuel flow valve to regulate the flow of fuel within a fuel conduit to the burner as a function of the air flow pressure in the air flow conduit. As the air flow is increased or decreased the pressure in the air flow conduit is increased or decreased thereby increasing or decreasing the flow of fuel.

It will be appreciated that the pressure balanced system is susceptible to changes in the air/fuel ratio when obstructions in the burner nozzle produce back pressure in the combustion air conduit and cause an increased rate of fuel flow while the air flow is actually reduced. Accordingly, the burner flame on heretofore known cupolas quite often "blows out" or operate "off-ratio" when raw material charges are dropped into the cupola in and around the burners. More particularly, the manner that the raw material charges are frequently added to the cupola results in a non-uniform charge depth or permeability of the raw material above the burners in the cupola. The nonuniform depth of raw material or permeability of charge results in back pressure variations above the burners. The burners, adversely affected by variations of back pressure created by the non-uniform arrangement of the raw material above the burners causes the burner to "blow out" or operate inefficiently because of an incorrect air/fuel ratio resulting in reduced flame temperature and stability. Unless indicated otherwise, as used herein, the term "fuel" refers to gaseous or liquid fuels such as natural gas, fuel oil and the like.

The problem of variable back pressure is compounded because the standard burner air/fuel control strategy is to manifold the burners so as to have one balanced pressure control for two or more burners of the cupola. As the back pressure varies from burner to burner, the air supplied to the burners tends to vary with the most amount of air flowing to the burner with the least back pressure resistance. Accordingly, the air flow and fuel flow and air/fuel ratio to the multiple burners is not acceptable because the burners bias on their own.

In addition to the problem of variable back pressure on the operation of the burner control system caused by the cupola charge, attachment of the burners to the cupola at a 90° angle to the cupola side wall also facilitates the build-up of molten and solid material in the burner tunnel. As previously described, build-up of molten and solid material in the burner tunnel adversely affects the air/fuel ratio thereby contributing to burner failure. In those instances where the build-up of material does not directly cause the burner to fail, the build-up of material does indirectly cause back pressure variations in the cupola thereby generating an inappropriate pressure signal to the burner causing it to fail or function improperly. Thus, this two fold problem requires frequent expensive maintenance down time to clean out the burner tunnels to maintain proper burner operation.

To alleviate the aforementioned problems we have invented an apparatus and a method for controlling the operation of each burner for a cupola. The system addresses flow pressure across the tunnel of each burner as well as air/fuel ratio pressure at the burner such that each burner is operatively controlled for constant burning under a variety of adverse operating conditions.

SUMMARY OF THE INVENTION

Briefly, according to this invention there is provided a method for controlling the operation of each burner of a cupola. The method includes the steps of separately supplying air and fuel to each burner and measuring either the mass or volumetric flow rates of air and fuel supplied to each burner, controlling either the flow rate of air or flow rate of fuel supplied to each burner as a function of the burner operating set-point and the corresponding measured flow rate of air or fuel supplied to each burner, and controlling the other of the flow rate supplied to each burner as a function of the corresponding measured flow rate of air or fuel supplied to each burner and the product of a preselected ratio of flow rate of fuel to flow rate of air supplied to each burner and differing measured flow rate of air or fuel supplied to each burner. The burner operating set point is established as a function of a desired heat energy output of the plurality of burners.

In one embodiment of the invention the burner operating set-point is determined by selecting a desired heat energy output of the plurality of burners; and determining an average heat energy output of the plurality of burners by dividing the desired heat energy output of the plurality of burners by the number of burners of the cupola.

In another embodiment of the present invention the burner operating set-point is determined by selecting a desired heat energy output of the plurality of burners; selecting a burner bias set-point for each burner as a function of cupola charging; and multiplying the burner bias set-point for each burner by the desired heat energy output of the plurality of burners divided by a sum of the burner bias set-points for each burner.

In yet another embodiment of the present invention, the burner operating set-point is determined by selecting a desired heat energy output of the plurality of burners; measuring either the air or fuel pressure supplied to each burner; and multiplying the pressure of either the air or fuel supplied to each burner by the desired heat energy output of the plurality of burners divided by a sum of the pressure of either the air or fuel supplied to each burner. In an alternate embodiment, oxygen may also be supplied to each burner of the cupola to enhance the combustion process.

The apparatus of burner control includes means for supplying air and fuel to each burner, means for measuring the flow rates of air and fuel supplied to each burner, means for regulating the air flow rate supplied to the burner and for regulating the fuel flow rate supplied to the burner and at least one controller. The controller is in communication with the regulating means and the measuring means. The at least one controller controlling either the air flow rate regulating means or the fuel flow rate regulating means as a function of a burner operating set-point and either the corresponding measured flow rate of air or flow rate of fuel supplied to each burner. In addition, the at least one controller controls the other flow rate regulating means as a function of the corresponding measured flow rate of air or fuel supplied to each burner and the product of a preselected ratio of flow rate of fuel to flow rate of air supplied to each burner and differing measured flow rate of air or fuel supplied to each burner.

In a preferred embodiment of the present invention, the control system includes means for selecting a desired heat energy output of all of the burners of the cupola, means for measuring either the air or fuel pressure supplied to each burner, and at least one controller in communication with the pressure measuring means, the regulating means and the measuring means. The at least one controller determines a burner operating set-point by multiplying the pressure of either the air or fuel supplied to each burner by the desired heat energy output of all of the burners divided by a sum of the pressure of either the air or fuel supplied to each burner.

It will be appreciated the method and apparatus of burner control is contemplated as being used on each burner of a multiple burner cupola.

BRIEF DESCRIPTION OF THE DRAWINGS

Further features and other objects and advantages of this invention will become clear from the following detailed description made with reference to the drawing in which.

DESCRIPTION OF THE PREFERRED EMBODIMENTS

Figure 1:
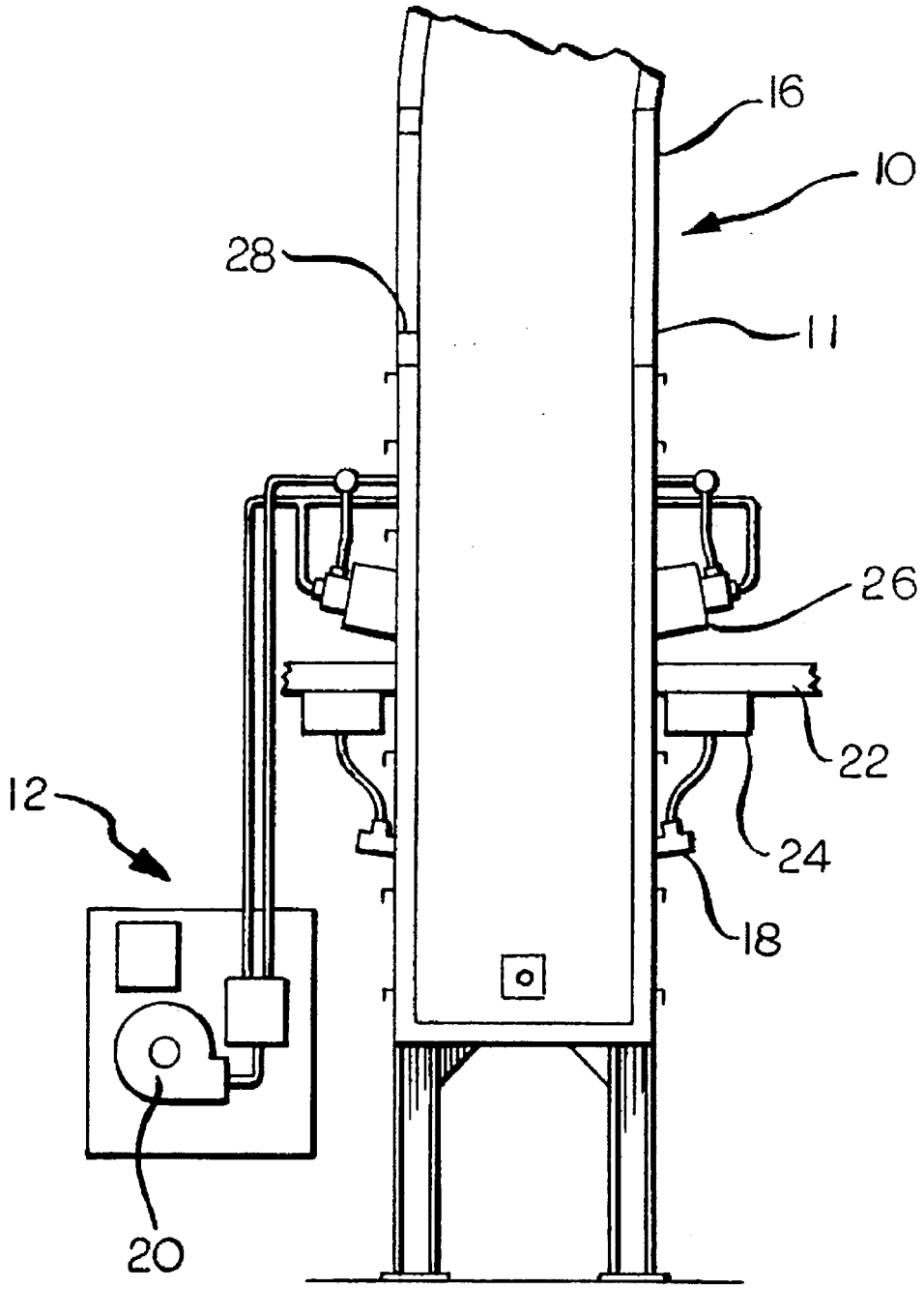
FIG. 1 is a schematic representation of a cupola furnace and a burner control system in accordance with the present invention.

Referring to the figures, a cupola 10 and a burner control system 12 in accordance with the present invention are shown. The cupola 10 generally includes a vertical shaft 14 having a refractory lining or water cooled lining open at the top and bottom. An outer metal plate shell 16 provides protection and support to the charge to be added to the cupola. Tuyeres 18 or openings extend through the metal plate shell 16 and refractory lining to introduce forced air to the cupola 10 to assist in the combustion process within the cupola. The air, which may be preheated, is supplied from a suitable blower (not shown) through a blast pipe 22 to an equalizing chamber commonly known as a windbox 24 which completely encircles the cupola 10 to supply air uniformly to the tuyeres 18.

By way of example, FIG. 1 illustrates a cupola 10 designed for melting ferrous castings, such as iron, steel, alloy iron, alloy steel and tool steel. The melting rate of the cupola 10 is approximately 5 tons per hour with grade 30 iron. Intermittent tapping and slagging of the cupola 10 may be employed with the metal tapped into a hot metal ladle (not shown). The exterior metal shell 14 of the cupola 10 has an internal diameter of approximately 52 inches. The shell 14 of the cupola is lined with a refractory material 16 to provide an internal shaft diameter of approximately 39 inches. The refractory material may consist of approximately 4½ inches high alumina firebrick in the upper shaft and 6½ inches in the melt zone.

The cupola 10 includes four tuyeres 18, each tuyere is approximately 4 inches in diameter. Forced air is added to the burning coke bed from the windbox 24 through the tuyeres or openings which extend through the metal plate shell 16 and refractory wall to the combustion zone just above the coke bed to promote combustion within the coke bed. The forced air, which may be preheated, is supplied from the blower (not shown) through conduit (not shown) to the blast pipe 22 and then to the windbox 24 which completely encircles the cupola 10. As known in the art, the coke is burned with the forced air to produce high temperature products of combustion. The high temperature products of combustion inherently ascend through the scrap metal, exchange heat with the scrap metal thereby melting the scrap metal and then exit out the top of the cupola at a relatively lower temperature. For comparison purposes, a representative distance from the tuyeres 18 to a charge sill of the cupola 10 is approximately 13 feet 11 inches, from the center of the tuyeres to the drop plate is approximately 2 feet 8 inches, and from the center of burners 26 to the drop plate is approximately 8 feet 6 inches. The distance from the bottom of the charge opening 28 to the drop plate is approximately 16 feet 7 inches. Although the construction of a specific cupola has been described in detail, the cupola 10 may be of most any size and shape in accordance with the function and performance desired of the cupola.

To enhance the melting of the scrap metal the cupola 10 includes burners 26. The burners 26 are direct fired nozzle mix tunnel burners of a conventional design wherein the fuel and oxidizer are mixed at the point of ignition. The burners 26 of the cupola 10 are positioned immediately above the windbox 24 and equi-spaced around the circumference of the cupola shell 16. The burners 26 are thus fired directly into the charge held immediately above the coke bed. Each burner 26 typically includes an inlet nozzle 30 and a sleeve 32 which projects through the refractory material lining of the cupola 10 into the combustion chamber formed by the internal shaft diameter of the cupola.

Traditional burner control systems have controlled the fuel/air ratio (F/A ratio) supplied to the burner 26 solely as a function of a pressure signal from a conduit providing air to the burner. The pressure signal typically activates a flow control valve to adjust the air flow in a set position required for operation. The pressure signal is also in communication with a fuel flow regulator which controls the flow of fuel to the burner in direct response to the amount of pressure within the air conduit. Assuming proper operation, an increase or decrease in air flow results in an increase or decrease in fuel flow to maintain a proper fuel/air ratio. However, it will be appreciated that the pressure balanced system is susceptible to false pressure readings due to blockages within the burner system 12. The blockages within the burner system pressurize the combustion air conduit and increase the pressure readings thereby increasing the rate of fuel flow even though the air flow is actually the same or reduced. Accordingly, the disproportionate change in fuel flow to air flow (F/A ratio) caused by the burner tunnel blockage and resultant back pressure of the air flow adversely affects the burner operation and performance. The present invention addresses the problem of burner tunnel blockage from molten and solid material within the cupola and the problem of controlling the fuel/air ratio inside the cupola 10 to the burners 26.

The burners 26 and tuyeres 18 of the cupola may be angled downward from a conventional horizontal arrangement to improve burner performance. Preferably, the burners 26 and tuyeres 18 are angled downward parallel to maintain the flow relationship of the products of combustion and heated air between the two input sources. The burners 26 and tuyeres 18 may be angled downwardly from horizontal at an angle ranging from approximately 0–20 degrees and most preferably, at an angle of approximately 10 degrees. It will be appreciated that by angling the burners 26 and associated tuyeres 18 downwardly, molten metal within the cupola 10 which may enter the burner sleeve 32 flows routinely out of the burner sleeve thereby preventing clogging of the burner sleeve and promoting an accurate pressure reading within the air flow conduit to the burners.

Figure 2:
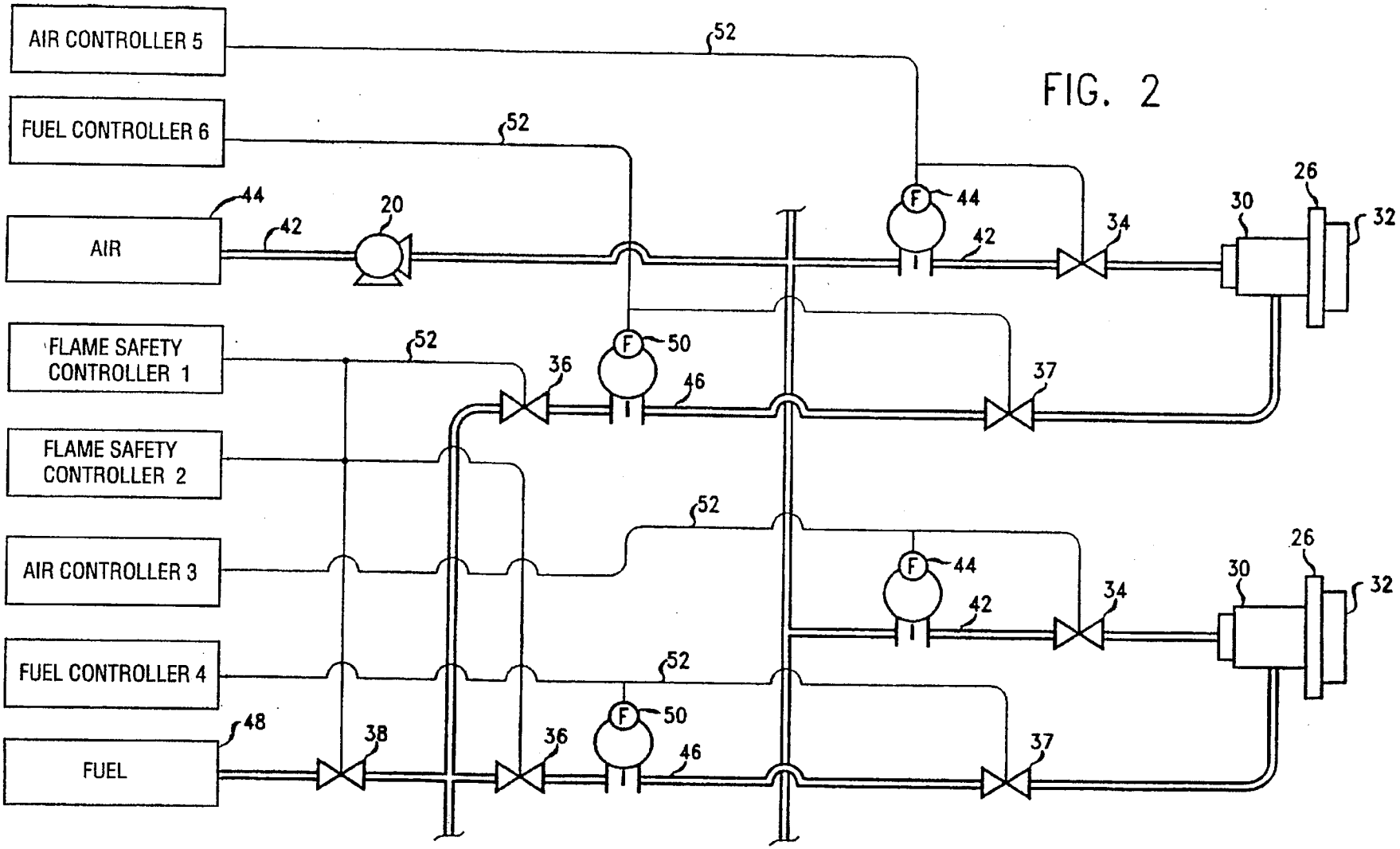
FIG. 2 is a flow diagram of the burner control system of FIG. 1.
Figure 3:
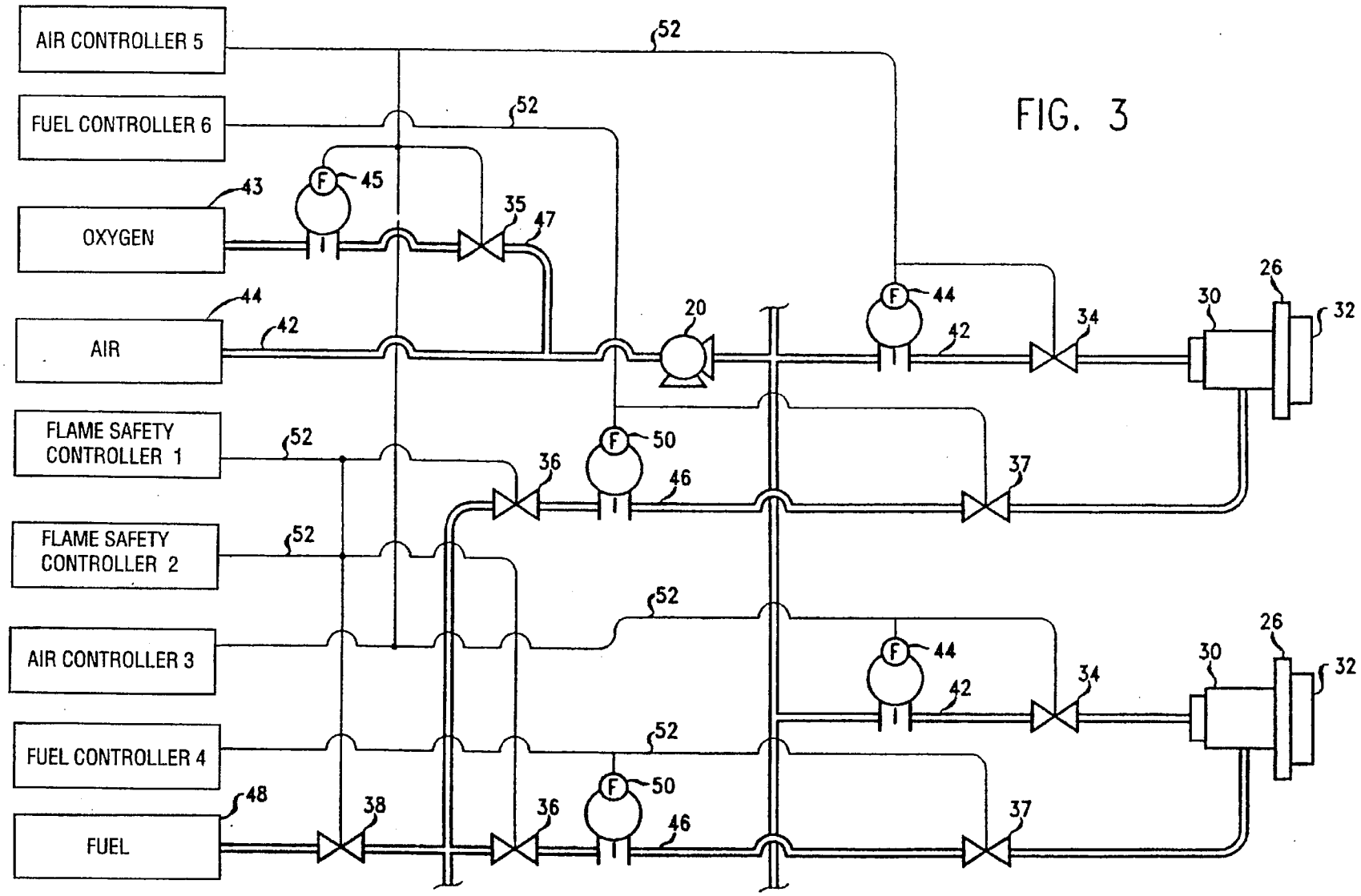
FIG. 3 is a flow diagram of an alternate burner control system of FIG. 1.
Figure 4:
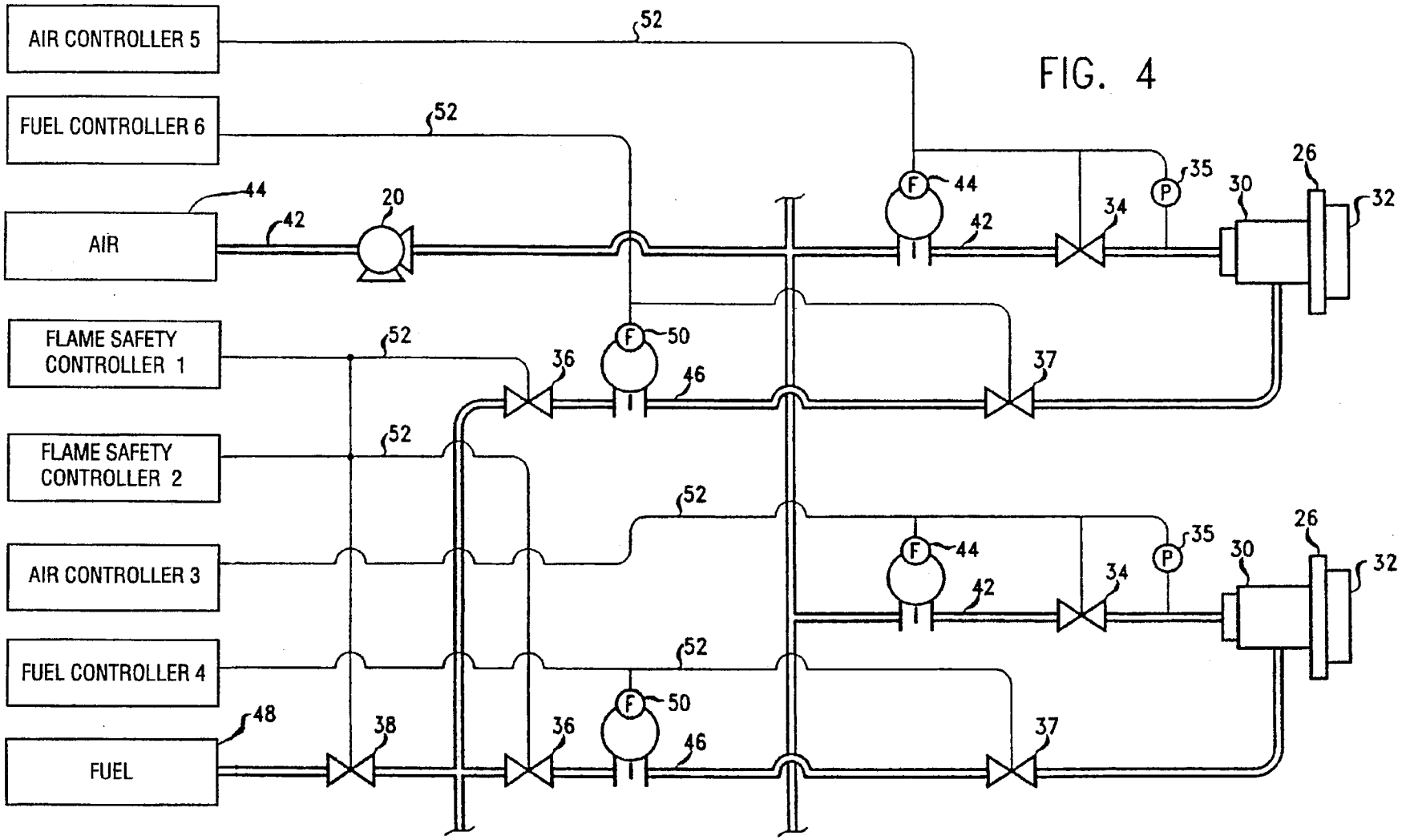
FIG. 4 is a flow diagram of another alternate burner control system of FIG. 1.

Referring to FIGS. 2–4, the burner control system 12 generally includes flow sensors 44 and 50, control elements 34, 36, 37, 38 and PID (proportional-integral-derivative) controllers (1, 2, 3, 4, 5 and 6). The flow sensors, control elements and controllers may be of most any type as selected by one skilled in the art based upon the specific operating requirements of the cupola 10.

Briefly, the burner control system 12 for controlling the fuel/air ratio to the burners 26 operates by measuring the mass or volumetric flow rate of both the air and the fuel flowing to each burner and adjusting the air flow rate and fuel flow rate accordingly to maintain a proper fuel/air ratio.

The system continually measures the rate of flow of fuel and air in the control system 12 and compares the measured rate of flow with set-point flow rate settings and a selected set-point fuel/air ratio setting and adjusts the flow control valves 34 and 37 as determined by the air controllers 3 and 5 and by the fuel controllers 4 and 6 as more fully explained herein.

It will be appreciated that the initial set-point flow rate settings and selected set-point fuel/air ratio data are determined experimentally for optimum performance of the cupola as a function of cupola design, operating condition and charge material. For example, a higher set-point fuel/air ratio setting may be used for a burner when producing specialty iron.

Air is supplied by an air blower 20 to each burner 26 through separate air conduit 42 from an air source 44. The air is supplied from the air blower 20 through conduit 42, air flow control valve 34 and an air flow sensor 44 to each burner 26. The air flow sensor 44 may be positioned upstream or downstream of each air flow control valve 34.

As shown in FIG. 3, oxygen may also be supplied to each burner 26 through conduit 47 from an oxygen source 43. The oxygen is supplied through a flow control valve 35 as modulated by flow sensor 45 in response to air controllers 3 or 5. It will be appreciated that the oxygen is added to the air to increase the burner performance.

Fuel is supplied to each burner through separate fuel conduit 46 from a fuel source 48. The fuel is supplied through conduit 46 to a main fuel blocking valve 38 and then distributed to each burner 26 through conduit 46 and a primary fuel blocking valve 36 and a secondary fuel flow control valve 37. A fuel flow sensor 50 for measuring the flow rate within the conduit 46 is also positioned between the primary fuel blocking valve 36 and the secondary fuel flow control valve 37 of each burner 26. As more fully described herein, flame safety controllers 1 and 2 control the operation of the main fuel blocking valve 38 and primary fuel blocking valve 36 during ignition of each burner 26.

The sensors 44 and 50 measure the flow rate of the air and the fuel by determining the local pressure difference within the conduit 42 and 46. This pressure is measured by making a small hole perpendicular to the surface of the conduit 42 and 46 and connecting the opening to a pressure sensor 44 and 50. A suitable pressure sensor is a model #1151 DP3E12M2B1 Rosemount differential pressure sensor. The sensor 44 and 50 senses the pressure differential across the hole within the conduit 42 and 46 and converts the pressure differential to an electrical signal that corresponds to the flow rate within the conduit.

It will be appreciated that the flow rates of the air and the fuel may be determined by using any suitable method known in the art such as either "true" flow rate meters which respond directly to flow rate or inferential flow rate meters which commonly measure volumetric flow rate and fluid density separately. Although it is preferred that the flow rates are measured as mass flow rates for precise burner control, the flow rates may also be measured as volumetric flow rates and provide acceptable burner control. Examples of "true" flow rate meters include Magnus-effect flow rate meters, radial-flow, transverse momentum flow rate meters, gyroscopic transverse-momentum flow rate meters, thermal flow rate meters and the like. Examples of inferential flow rate meters include head meters with density compensation, head meters with velocity compensation and velocity meters with density compensation.

The control elements 34 and 37 operate in response to a control signal from the PID controllers 3–6 via lines 52. The control elements 34 and 37 are modulated flow control valves and the like as is known in the art.

The PID controllers 3–6 of the burner control system 12 contain the control functions for controlling the control elements 34 and 37 in the system. The PID controllers 3–6 may be programmable logic controllers of conventional design such as Allen Bradley SLC-500 programmable logic controllers. Field data in the form of analog inputs and outputs are transmitted to the controllers 3–6 via lines 52 from the sensors 44 and 50 and from the controllers to the control elements 34 and 37. The controllers 3–6 receive an analog signal from the sensors 44 and 50, convert the signal into a numerical value, compare this value with a set-point, calculate the proper output signal using a PID algorithm, convert the result into an analog value and send a signal corresponding to this value to the control elements 34 and 37. The value of the flow may be displayed by a computer operated display device such as a cathode ray tube (not shown).

Figure 5:
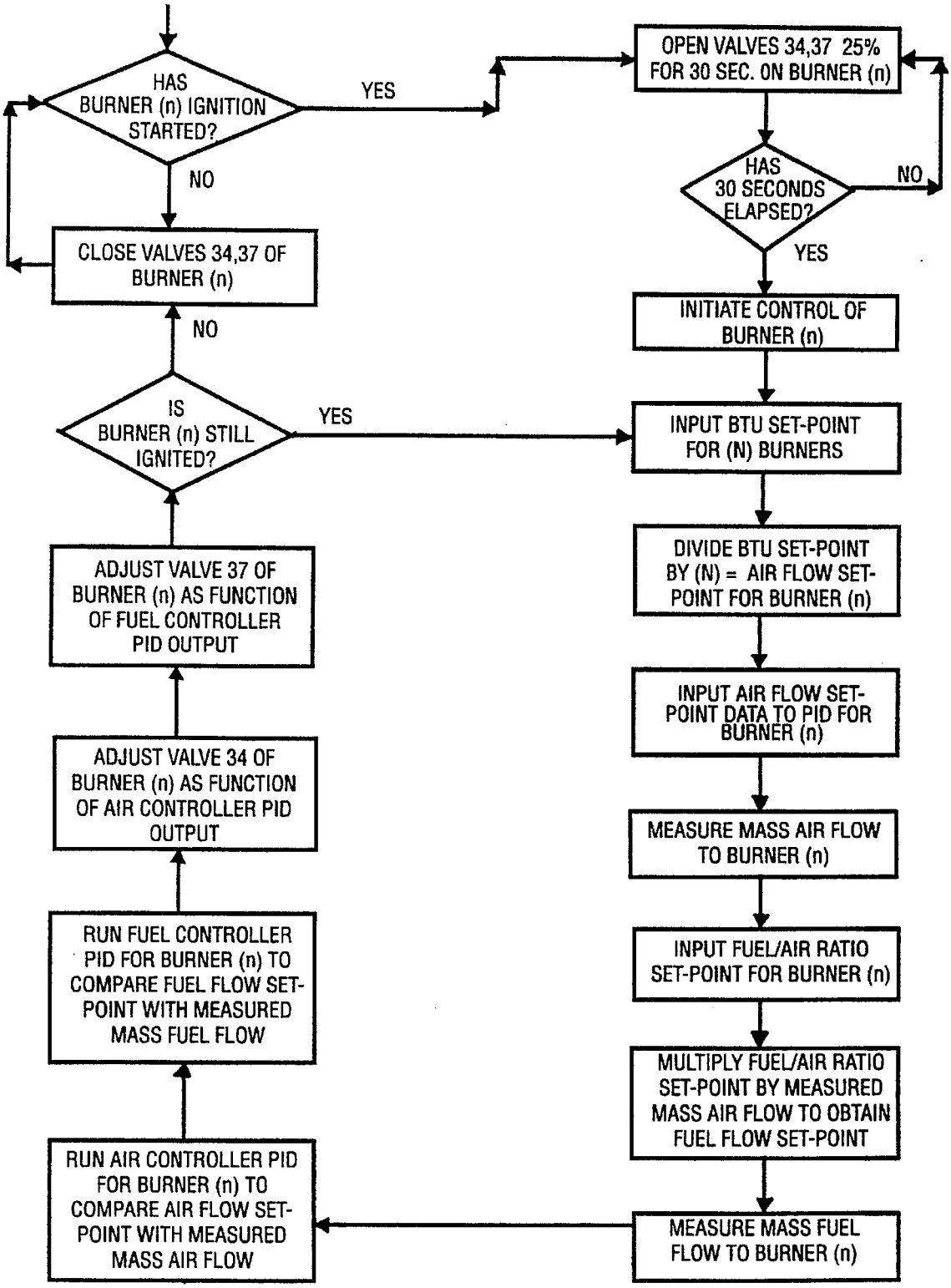
FIG. 5 is a flow chart of the control logic of the burner control system of FIG. 2.

In accordance with one embodiment of the present invention as shown in FIGS. 2 and 5 the output of each air flow sensor 44 is connected to an air controller 3 and 5 which compares the sensed pressure differential corresponding to the air flow rate with a burner operating set-point identified in FIG. 5 as the air flow set-point (AIR FLOW SET-POINT). The air flow set-point corresponds to an average heat energy output of each burner as determined by dividing a desired overall heat energy output of all of the burners of the cupola (BTU SET-POINT FOR (N) BURNERS) by the number of burners of the cupola (N). The air flow valve 34 of each burner 26 is then adjusted as a function of the difference between the air flow set-point and the measured air flow to the burner by the air controllers 3 and 4. As used herein, the term "n" refers to any one burner of the cupola and "N" refers to the number of burners of the cupola or all of the burners of the cupola as indicated by the specific context in which the term appears.

In addition, the output of each fuel flow sensor 50 is connected to the controllers 4 and 6 which compares the sensed pressure differential corresponding to the fuel flow rate with a set-point corresponding to the product of the measured air flow rate across the corresponding air conduit 42 and a predetermined range of operable fuel/air ratios to produce a signal which controls the secondary fuel flow control valve 37.

Figure 6:
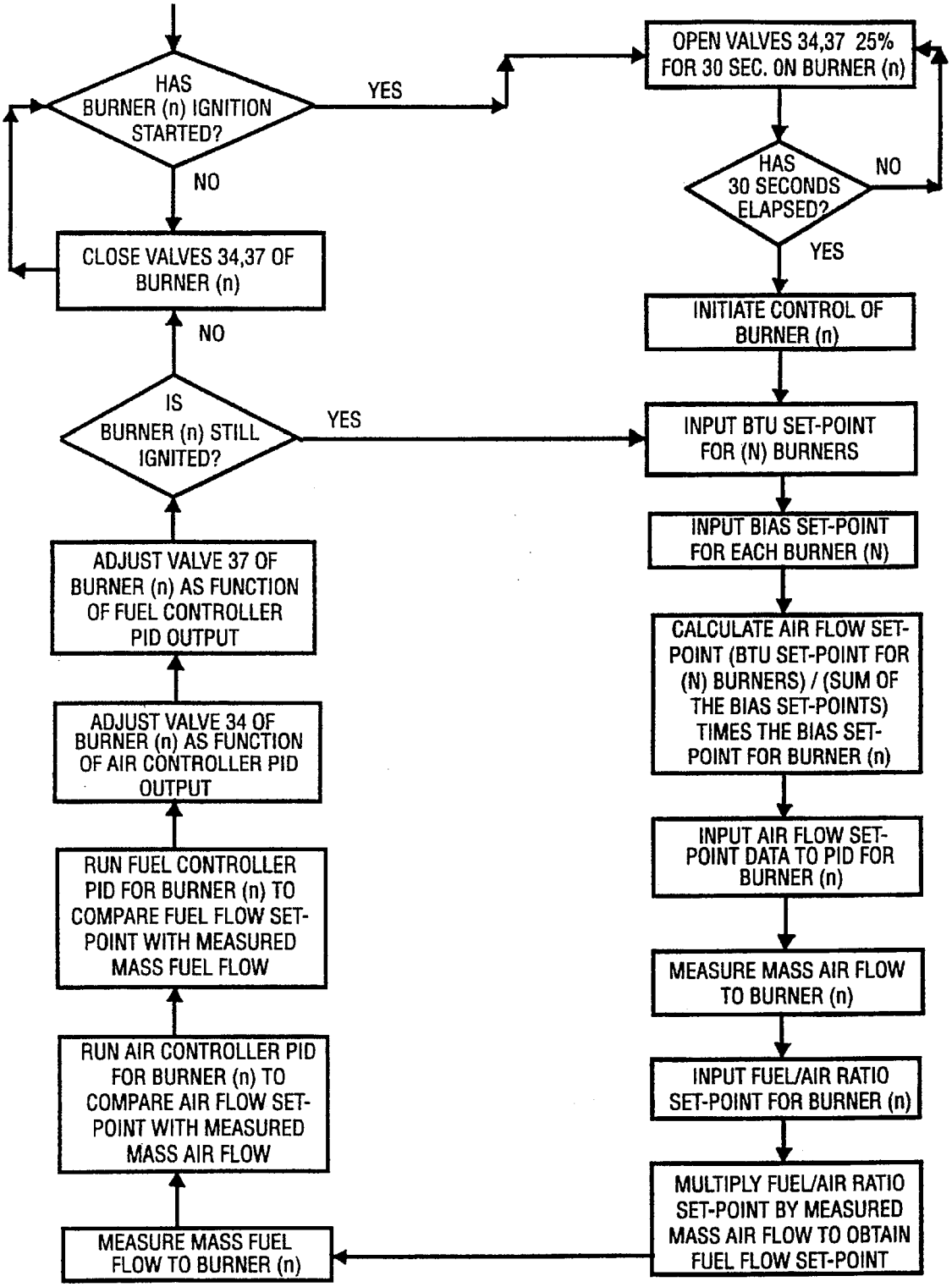
FIG. 6 is a flow chart of the control logic of the burner control system of FIG. 3.

In yet another embodiment of the present invention as shown in FIGS. 3 and 6, the output of each air flow sensor 44 is in communication with an air controller 3 and 5 which compares the sensed pressure differential corresponding to the air flow rate with a burner operating set-point identified in FIG. 6 as the air flow set-point (AIR FLOW SET-POINT). The burner operating set-point or air flow set-point is determined as a function of the BIAS SET-POINT FOR EACH BURNER (n). The BIAS SET-POINT FOR EACH BURNER (n) is a function of the percentage of charge positioned adjacent a single burner relative to the percentage of charge positioned adjacent the remaining burners of the cupola. (BIAS SET-POINT FOR EACH BURNER (n)). As previously explained, a raw material charge is routinely added to a cupola from one side of the cupola such that the raw material generally accumulates on one side. Accordingly, because the raw material accumulates on one side of the cupola, for efficient operation it is preferred that the heat energy added by the burners be distributed as needed by controlling the firing of the burners to compensate for the larger mass of raw material to be heated at one location than at another location.

The burner operating set-point or air flow set-point (AIR FLOW SET-POINT) is determined by selecting the heat energy output desired for all of the burners of the cupola (BTU SET-POINT FOR (N) BURNERS), determining the percentage of charge adjacent each burner relative to the other burners (BIAS SET-POINT FOR EACH BURNER (n)) and multiplying the bias set-point for each burner (n) by the heat energy output of the plurality of burners (BTU SET-POINT FOR (N) BURNERS) divided by a sum of the burner bias set-points for each burner. The burner operating set-point or air flow set-point (AIR FLOW SET-POINT) is then compared with the measured air flow by controllers 3 and 5 to produce a signal which adjusts the air flow valve 34 of each burner 26 as required.

In addition, the output of each fuel flow sensor 50 is connected to the controllers 4 and 6 which compares the sensed pressure differential corresponding to the fuel flow rate with a set-point corresponding to the product of the sensed air flow rate across the corresponding air conduit 42 and a predetermined range of operable fuel/air ratios to produce a signal which controls the secondary fuel flow control valve 37.

Figure 7:
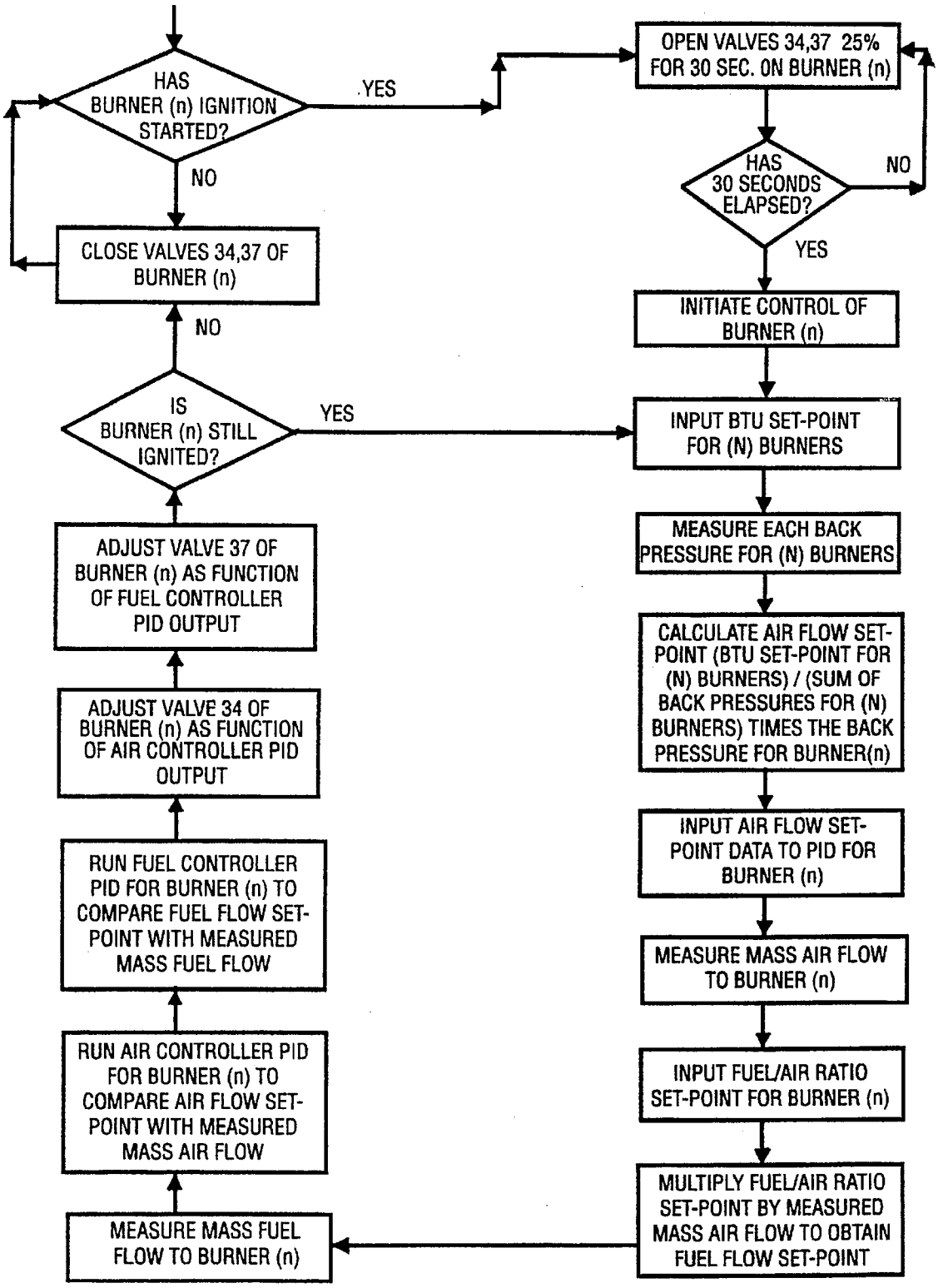
FIG. 7 is a flow chart of the control logic of the burner control system of FIG. 4.

Referring to FIGS. 4 and 7, yet another embodiment of the present invention is shown. The output of each air flow sensor 44 is connected to an air controller 3 and 5 which compares the sensed pressure differential corresponding to the air flow rate with a burner operating set-point identified in FIG. 7 as the air flow set-point (AIR FLOW SET-POINT). The burner operating set-point or air flow set-point (AIR FLOW SET-POINT) is determined as a function of the measured air burner back pressure of the air supplied to each burner (BACK PRESSURE FOR BURNER (n)) by pressure sensor 35 and the desired overall heat energy output of all of the burners of the cupola (BTU SET-POINT FOR (N) BURNERS). It will be appreciated that the amount of charge positioned in front of each burner sleeve 32 affects the flow pressure of the air and fuel supplied to the burner. As charge material accumulates in front of a burner sleeve 32 the pressure within the supply lines 42 and 46 increases. The increased pressure within the supply lines 42 and 46 is sensed by pressure sensor 35 and then communicated to the controllers 3 and 5. The controllers 3 and 5 determine the burner operating set-point or air flow set-point (AIR FLOW SET-POINT) for each burner by multiplying the burner back pressure of the air supplied to each burner (BACK PRESSURE FOR BURNER (n)) by the desired heat energy output of the plurality of burners (BTU SET-POINT FOR (N) BURNERS) divided by a sum of each burner back pressure of the air supplied to each burner (BACK PRESSURE FOR (N) BURNERS). The burner operating set-point or air flow set-point (AIR FLOW SET-POINT) is then compared with the measured air flow by the controllers 3 and 5 to produce a signal which adjusts the air flow valve 34 of each burner 26 as required.

The output of each fuel flow sensor 50 is connected to the controllers 4 and 6 which compares the sensed pressure differential corresponding to the fuel flow rate with a set-point corresponding to the product of the sensed air flow rate across the corresponding air conduit 42 and a predetermined range of operable fuel/air ratios to produce a signal which controls the secondary fuel flow control valve 37.

Although the present invention has been described with reference to a two burner system having multiple controllers 3–6 for ease of understanding, any number of burners may be employed in the cupola merely by increasing the number of sensors and controllers as required. Furthermore, in the foregoing description of the present invention, the various embodiments of the present invention have been described with reference to a burner control system in which the fuel flow rate is adjusted as a function of the air flow rate, however, it will be appreciated that the burner control system may also function by adjusting the air flow rate as a function of the fuel flow rate. For example, referring to FIG. 2, the control system may be modified by exchanging the sensors 50 and control valves 36 and 37 on each fuel conduit 46 with the sensors 44 and control valves 34 on each corresponding air conduit 42. Consequently, in operation, the output of each fuel flow sensor is connected to a controller which compares a sensed pressure differential corresponding to a fuel flow rate with a set-point corresponding to a predetermined heat energy output of the cupola to produce a signal which adjusts a fuel flow valve of each burner. In addition, the output of each air flow sensor is connected to a controller which compares a sensed pressure differential corresponding to the air flow rate with a set-point corresponding to a product of the sensed fuel flow rate across a corresponding fuel conduit and a predetermined range of operable air/fuel ratios to produce a signal which controls a secondary air flow control valve.

It will be appreciated that by adjusting the fuel flow rate as a function of the measured air flow rate and measured fuel flow rate or by adjusting the air flow rate as a function of the measured fuel flow rate and measured air flow rate a proper operating fuel/air ratio is achieved at the burner 26 regardless of pressure differentials experienced at the burner sleeve 32.

In the operation of the cupola, ignition of the burner 26 is accomplished by first opening all of the valves 34, 36, 37, 38 to each burner 26 and purging the system for safety reasons to create a noncombustible atmosphere within the burner nozzle 30. For example, purging may be accomplished by introducing nitrogen to the burner system 12 as known in the art. Once an inert atmosphere is established within the burner 26, a low fire within the burner is established. A low fire condition is established by flame safety controllers 1 and 2 opening the main fuel blocking valve 38 and primary fuel blocking valve 36 and air controllers 3 and 5 partially opening the air flow 34 and fuel flow control valves 37 approximately 25% open for about 30 seconds. The fuel flow control and air flow control valves are approximately 1¼ inch and 3 inch in diameter.

Air and fuel from the air source 44 and fuel source 48 are simultaneously selectively introduced at ignitable proportions to the burner 26 where the mixture is ignited or energized by an igniter (not shown) as known in the art. The igniter may be, for example, of an electric spark type, hot surface type, flame type or shock wave type. The igniter raises the mixture of fuel and air to the ignition temperature to produce a flame. In a preferred embodiment, an electric spark igniter of a type known in the art provides approximately 6,000–15,000 volts and preferably 12,000 volts to ignite the mixture of fuel and air approximately 5 seconds after introducing fuel and air to the burner 26. Once the igniter ignites the mixture of fuel and air as determined by flame sensors (not shown) and 30 seconds have elapsed, the operation of the air flow control valve 34 and fuel flow control valve 37 is controlled by the PID controllers 3–6.

In the event of either combustion air or fuel pressure failure or burner flame blowout, the burners 26 are designed to shut down automatically by closing the blocking valve 36 of the burner experiencing pressure failure or flame blowout in response to a signal from the flame safety controllers 1 and 2, as detected by ultra-violet sensing cells (not shown) of a conventional design. In the event all of the burners 26 of the cupola experience pressure failure or flame blowout then all of the burners 26 shut down automatically by closing the blocking valves 36 and 38 in response to a signal from the flame safety controllers 1 and 2.

As described above, the individual components of the burner control system 12 are conventional in nature. In addition, FIGS. 2–4 are simplified schematic representations of the burner control system 12 to aid in understanding of the present invention. Additional regulator valves, pressure test valves, sensors, detectors and the like may be added to the burner control system as desired. Reference is made to Perry and Chilton, CHEMICAL ENGINEERS' HANDBOOK, 5th Edition, McGraw Hill, New York, 1973, and to the burner control industry literature generally for detailed descriptions on the various process control apparatus and conditions.

The burner control system in accordance with the present invention will be further clarified by a consideration of the following examples, which are intended to be purely exemplary of the use of the invention on a cupola.

EXAMPLE 1

One cupola as previously described having a carbon steel combustion chamber lined with 70% high alumina refractory shapes and insulation blanket was fitted With four Hauck nozzle mix natural gas burners, each burner was rated at 1.5 mm BTU/hour at 16 ounces of air pressure. The burners were angled downward at 10 degrees from horizontal and fired approximately 12 inches above the coke bed. Automatic proportioning of the fuel/air ratio was accomplished by an Allen Bradley SLC-500 process control computer as previously described and shown in FIGS. 2 and 4. The computer is capable of varying the fuel/air ratio from stoichiometric to 40% excess air or 20% excess fuel.

During the test, the predetermined set-point air flow was varied and the predetermined set-point air/fuel ratio was set at 10:1 based upon a desired burner output. It was observed during the test that the burner operated uniformly with no burner flame out for a full days normal production. Representative values of a desired BTU output of each burner based upon a varying set-point air flow rate and adjusted fuel flow rate are provided in Table 1.

TABLE 1

| BTU | Measured Air Flow (SCFH) | Adjusted Fuel Flow (SCFH) |
|---|---|---|
| 0.36 | 3590 | 356 |
| 0.51 | 5078 | 505 |
| 1.01 | 10155 | 1013 |
| 1.43 | 14400 | 1430 |

EXAMPLE 2

A test was conducted to compare the operating performance of a cupola using only coke fuel and a cupola using a combination of coke fuel and supplemental burners fueled with natural gas. The cupola had a shell inside diameter of approximately 52 inches and an internal shaft diameter of 39 inches. The lining is 4½ inches high alumina firebrick in the upper shaft, 6½ inches in the melt zone. There are four tuyeres, each tuyere is 4 inches in diameter. The distance from the tuyeres to the charge sill is about 13 feet 11 inches, from the center of the tuyeres to the drop plate is 2 feet 8 inches, and from center of the burners to the drop plate is 8 feet 6 inches. The distance from the bottom of the charge door to the drop plate is 16 feet 7 inches. The coke bed is 52 inches above the center of the tuyeres. There are 4 gas burners. The melting rate is 5 tons per hour with grade 30 iron. Intermittent tapping and slagging is employed with the metal tapped into a hot metal ladle.

Coke was first added to the cupola to establish an 1800 lb. coke bed. Then the cupola was charged to fill the cupola. Initially, the cupola was charged about 10 times to fill the cupola. Each charge was as follows:

| Charge | Amount (lbs.) |
|---|---|
| Pig iron | 250 |
| Gray iron | 400 |
| Cast iron | 350 |
| Manganese | 1 ½ |
| Ferro Silica | 2 |
| Limestone | 40 |

After the cupola was filled to capacity with the charge, the amount of coke added to the cupola per charge added to the cupola was dropped to 140 lbs. total. The result of the operation of the cupola without the use of supplemental burners is provided in Table 2 and identified as Run 1.

For comparison purposes, an identical charging practice was then performed on the same cupola equipped with supplemental burners in accordance with the present invention as shown in FIGS. 2 and 4. The results of the operation of the cupola with the use of supplemental burners is provided in Table 2 and identified as Runs 2 and 3. As shown in Table 2 when comparing Run 1 and Runs 2 and 3, the production rate increased and production costs decreased due to the use of less coke and the market price difference between coke and natural gas at the time of the test.

TABLE 2

| Run | 1 | 2 | 3 |
|---|---|---|---|
| Air/Fuel ratio | — | 10/1 | 10/1 |
| Production rate (tons iron/hr) | 14.6 | 18.6 | 21.69 |
| Coke charged (Btu/ton iron) | 300 | 240 | 210 |
| Natural gas (MMBtu/hr) | 0 | 10 | 15 |
| Increase in Production | — | 28.3% | 49.5% |

Having described presently preferred embodiments of the present invention it may be otherwise embodied within the scope of the appended claims.

What is claimed is:

1. A method of individually controlling the operation of a plurality of burners of a cupola, the method comprising:

(a) separately supplying air and fuel to each burner;

(b) measuring the flow rates of air and fuel supplied to each burner;

(c) establishing a burner operating set-point as a function of a desired heat energy output of the plurality of burners;

(d) controlling either the flow rate of air or flow rate of fuel supplied to each burner as a function of the burner operating set-point and the corresponding measured flow rate of air or fuel supplied to each burner; and (e) controlling the other of the flow rate supplied to each burner as a function of the corresponding measured flow rate of air or fuel supplied to each burner and the product of a preselected ratio of flow rate of fuel to flow rate of air supplied to each burner and differing measured flow rate of air or fuel supplied to each burner.

2. The method of claim 1 further comprising the steps of:

(a) supplying oxygen to each burner of the cupola;

(b) measuring the flow rate of oxygen supplied to each burner;

(c) controlling the flow rate of oxygen supplied to each burner as a function of the measured flow rate of air supplied to each burner.

3. The method of claim 1 wherein said step of establishing a burner operating set-point includes the steps of:

(a) selecting a desired heat energy output of the plurality of burners; and (b) determining an average heat energy output of each of burner by dividing the desired heat energy output of the plurality of burners by the number of burners of the cupola.

4. The method of claim 3 further comprising the steps of:

(a) comparing the burner operating set-point with either the measured flow rate of air or fuel supplied to each burner; and (b) controlling at least one valve regulating the flow rate of air or fuel supplied to each burner in response to a compared difference determined by a controller between the burner operating set-point of each burner and the measured flow rate of air or fuel supplied to each burner.

5. The method of claim 4 further comprising the steps of:

(a) opening each of the at least one valves regulating the flow rates of fuel and air supplied to the burner to provide an ignitable mixture; and (b) igniting the mixture of fuel and air in each burner.

6. The method of claim 5 wherein each of the at least one valves are opened at least 25 percent for about 30 seconds.

7. The method of claim 6 further comprising the steps of:

(a) detecting for a flame within the burner after lapse of 30 seconds; and (b) closing each of the at least one valves if a flame is not detected within each burner.

8. The method of claim 1 wherein said step of establishing a burner operating set-point includes the steps of:

(a) selecting a desired heat energy output of the plurality of burners;

(b) selecting a burner bias set-point for each burner as a function of cupola charging; and (c) multiplying the burner bias set-point for each burner by the desired heat energy output of the plurality of burners divided by a sum of the burner bias set-points for each burner.

9. The method of claim 8 further comprising the steps of:

(a) comparing the burner operating set-point with either the measured flow rate of air or fuel supplied to each burner; and (b) controlling at least one valve regulating the flow rate of air or fuel supplied to each burner in response to a compared difference determined by a controller between the burner operating set-point of each burner and the measured flow rate of air or fuel supplied to each burner.

10. The method of claim 9 further comprising the steps of:

(a) opening each of the at least one valves regulating the flow rates of fuel and air supplied to the burner to provide an ignitable mixture; and (b) igniting the mixture of fuel and air in each burner.

11. The method of claim 10 wherein each of the at least one valves are opened at least 25 percent for about 30 seconds.

12. The method of claim 11 further comprising the steps of:

(a) detecting for a flame within the burner after lapse of 30 seconds; and (b) closing each of the at least one valves if a flame is not detected within each burner.

13. The method of claim 1 wherein said step of establishing a burner operating set-point includes the steps of:

(a) selecting a desired heat energy output of the plurality of burners;

(b) measuring either the air or fuel pressure supplied to each burner; and (c) multiplying the pressure of either the air or fuel supplied to each burner by the desired heat energy output of the plurality of burners divided by a sum of the pressure of either the air or fuel supplied to each burner.

14. The method of claim 13 further comprising the steps of:

(a) comparing the burner operating set-point with either the measured flow rate of air or fuel supplied to each burner; and (b) controlling at least one valve regulating the flow rate of air or fuel supplied to each burner in response to a compared difference determined by a controller between the burner operating set-point of each burner and the measured flow rate of air or fuel supplied to each burner.

15. The method of claim 14 further comprising the steps of:

(a) opening each of the at least one valves regulating the flow rates of fuel and air supplied to the burner to provide an ignitable mixture; and (b) igniting the mixture of fuel and air in each burner.

16. The method of claim 15 wherein each of the at least one valves are opened at least 25 percent for about 30 seconds.

17. The method of claim 16 further comprising the steps of:

(a) detecting for a flame within the burner after lapse of 30 seconds; and (b) closing each of the at least one valves if a flame is not detected within each burner.

18. A control system for controlling the operation of a burner of a cupola comprising:

(a) means for supplying air and fuel to each burner;

(b) means for measuring the flow rates of air and fuel supplied to each burner;

(c) means for regulating the air flow rate supplied to the burner and for regulating the fuel flow rate supplied to the burner;

(d) at least one controller in communication with said regulating means and said measuring means, said at least one controller controlling either said air flow rate regulating means or said fuel flow rate regulating means as a function of a burner operating set-point and either the corresponding measured flow rate of air or flow rate of fuel supplied to each burner and controlling said other flow rate regulating means as a function of the corresponding measured flow rate of air or fuel supplied to each burner and the product of a preselected ratio of flow rate of fuel to flow rate of air supplied to each burner and differing measured flow rate of air or fuel supplied to each burner.

19. The control system of claim 18 further comprising:

(a) means for selecting a desired heat energy output of the plurality of burners;

(b) means for measuring either the air or fuel pressure supplied to each burner; and (c) at least one controller in communication with said pressure measuring means, said regulating means and said measuring means, said at least one controller for determining said burner operating set-point by multiplying the pressure of either the air or fuel supplied to each burner by the desired heat energy output of a plurality of burners divided by a sum of the pressure of either the air or fuel supplied to each burner.

20. The control system of claim 19 further comprising:

(a) means for supplying a flow rate of oxygen to the burner;

(b) means for measuring the flow rate of oxygen supplied to the burner, said measuring means in communication with a controller; and (c) means for regulating the flow rate of oxygen supplied to the burner; said regulating means in communication with said controller for controlling the flow rate of oxygen supplied to the burner as a function of the combined measured flow rate of oxygen and air supplied to the burner.

21. The control system of claim 20 wherein said supplying means includes an air conduit for providing air from an air source to the burner and a fuel conduit for providing fuel from a fuel source to the burner.

22. The control system of claim 21 wherein said regulating means includes at least one air flow rate control valve for regulating the flow rate of air within said air conduit in response to said controller and at least one fuel flow rate control valve for regulating the flow rate of fuel within said fuel conduit in response to said controller.

23. The control system of claim 22 wherein said measuring means includes at least one air sensor in communication with said controller for measuring the flow rate of air from said air source supplied to the burner; and at least one fuel sensor in communication with said controller for measuring the flow rate of fuel from said fuel source supplied to the burner.

24. The control system of claim 23 where said at least one air sensor measures the flow rate of air by sensing a local pressure difference across a hole within said conduit.

25. The control system of claim 24 wherein the burners are angled downwardly from horizontal at an angle ranging from approximately 0–20 degrees.

26. The control system of claim 25 wherein said fuel is natural gas.

27. The control system of claim 26 wherein said controller is a proportional-integral-derivative controller.

* * * * *